United States Patent [19]

Herrington

[11] Patent Number: 5,007,143

[45] Date of Patent: Apr. 16, 1991

[54] ROLLING ACTION ZIPPER PROFILE AND SLIPPER THEREFOR

[75] Inventor: Fox J. Herrington, Holcomb, N.Y.

[73] Assignee: Mobil Oil Corp., Fairfax, Va.

[21] Appl. No.: 490,110

[22] Filed: Mar. 7, 1990

[51] Int. Cl.[5] ..... A44B 19/16

[52] U.S. Cl. ..... 24/400; 24/399; 24/587

[58] Field of Search ..... 24/400, 399, 587, 576, 24/297; 383/63, 65; 156/66

[56] References Cited

U.S. PATENT DOCUMENTS

| | | | |
|---|---|---|---|
| 3,103,049 | 9/1963 | Hawley | 24/400 |
| 3,203,062 | 8/1965 | Ausnit | 24/400 |
| 3,220,076 | 11/1965 | Ausnit et al. . | |
| 3,347,298 | 10/1967 | Ausnit et al. | 150/3 |
| 3,426,396 | 2/1969 | Laguerre . | |
| 3,462,332 | 8/1969 | Goto | 156/244 |
| 3,579,947 | 5/1971 | Hawley | 24/400 |
| 3,660,875 | 5/1972 | Gutman . | |
| 3,713,923 | 1/1973 | Laguerre | 156/66 |
| 3,790,992 | 2/1974 | Herz . | |
| 3,806,998 | 4/1974 | Laguerre . | |
| 4,262,395 | 4/1981 | Kosky | 24/400 |
| 4,736,451 | 4/1988 | Ausnit . | |

FOREIGN PATENT DOCUMENTS

| | | | |
|---|---|---|---|
| 1168794 | 12/1958 | France | 24/399 |
| 0581864 | 9/1958 | Italy | 24/400 |
| 0914203 | 12/1962 | United Kingdom | 24/400 |

*Primary Examiner*—Victor N. Sakran

*Attorney, Agent, or Firm*—Alexander J. McKillop; Charles J. Speciale

[57] ABSTRACT

A novel zipper profile is disclosed in which the cross-sectional shape of the zipper is such that it can be closed most easily by pressing the bottom together first, then rolling it closed toward the top. The novel slider is shaped so that it operates in this fashion on the zipper profile, holding the top open while it presses the bottom together, then presses the top together while the slider passes by.

11 Claims, 3 Drawing Sheets

ROLLING ACTION ZIPPER PROFILE AND SLIPPER THEREFOR

BACKGROUND OF THE INVENTION

The present invention relates to improvements in plastic reclosable fasteners with sliders particularly suited for thermoplastic bags and the like and particularly to a rolling action zipper profile which closes most easily by pressing it together first at the bottom and then rolling it closed toward the top.

Zippers with sliders are made commercially in several forms. The most common ones uses on clothing have teeth which interlock. The teeth may be made of metal or plastic. Other types of plastic zippers have profiles that include a pair of male and female fastener elements in the form of reclosable interlocking rib and groove elements with the slider for opening or closing the rib and groove elements. In the manufacture of thermoplastic film bags, a pair of these male and female fastener elements extend along the mouth of the bag and these male and female elements are adapted to be secured in any suitable manner to the flexible walls of the thermoplastic film bag. These elements may be integral marginal portions of such walls or they may be extruded separately and thereafter attached to the walls along the mouth of the bag. A method of continuously providing such a fastener on the thermoplastic film is disclosed in U.S. Pat. No. 3,462,332.

The sliders for opening or closing the reclosable fasteners are essentially U-shaped and adapted to be assembled with the fastener or zipper by an endwise assembly or by a relative transverse maneuver. Where the assembly is performed by a relative transverse maneuver, the slider is normally molded from a semi-hard plastic where there is enough yieldability in the side walls of the slider to provide sufficient flexibility to enable spreading apart of the terminal portions of the side walls of the slider so as to clear the interlocking rib and groove elements to permit assembly of the slider with the zipper by relative transverse movement. Where the slider is formed from a metal die-casting or a hard plastic, it has been necessary to rely upon the elastic deformation of the plastic zipper elements to permit the transverse assembly movement of the slider. Such assembly can cause damage to the interlocking rib and groove elements during assembly and leaves something to be desired. Examples of assembly of sliders with plastic reclosable fasteners are disclosed in U.S. Pat. Nos. 3,426,396, 3,660,875, 3,713,923, 3,790,992 and 3,806,998. Flexible plastic zippers of the type having three or more rib and groove continuous interlocking elements thereon are disclosed in U.S. Pat. No. 4,199,845. In this patent, a method is employed wherein the different rib and grooves of each of the tracks are closed progressively one after another so that each one has enough room to interlock before the next one to it is required to respond in the same way. The slider includes an angled bar which successively deforms and interlocks the rib and grooves one after the other from one side to the other side of each of the strips.

Other commercial plastic zippers with sliders have been made by Baron Industries, New York, N.Y., Flexico France, Henonville, France, and some have been imported from Japan by YKK, Lyndhurst, N.J. All of these use a similar profile namely two pairs of hooked shaped elements which are adapted to interlock to hold the zipper closed. The profile is pressed straight together, as is a conventional plastic zipper. When it is opened it is pried straight apart by the separator tab on the slider.

RELATED APPLICATIONS

A method of assembling a metal slider with a plastic reclosable fastener is disclosed in my related application entitled "Method of Assembling Metal Slider with a Plastic Reclosable Fastener" Ser. No. 490,114 filed concurrently herewith and incorporated herein by reference thereto. A method of assembling a plastic slider with a plastic reclosable fastener is disclosed in my related application entitled "Method of Assembling a Snapped Together Multi-Part Plastic Slider with a Plastic Reclosable Faster," Ser. No. 490,107 filed concurrently herewith and incorporated herein by reference thereto. Another method of assembling a plastic slider with a plastic reclosable fastener is disclosed in my related application entitled "Method of Assembling a Multi-Part Plastic Slider with a Plastic Reclosable Fastener by Ultrasonic Welding" Ser. No. 490,109 filed concurrently herewith and incorporated herein by reference thereto. A plastic leakproof zipper with slider is disclosed in the related application of F. J. Herrington and E. A. St. Phillips entitled "Leakproof Zipper with Slider" Ser. No. 490,112 filed concurrently herewith and incorporated herein by reference thereto. A foldable plastic slider for a plastic reclosable fastener is disclosed in the related application of F. J. Herrington and A. Goncarovs entitled "Foldable Plastic Slider and Method of Assembly with a Plastic Reclosable Fastener" Ser. No. 490,108 filed concurrently herewith and incorporated herein by reference thereto. Another foldable plastic slider is disclosed in my related application entitled "Gull Wing Zipper Slider" Ser. No. 490,106 filed concurrently herewith and incorporated herein by reference thereto. All of the above-identified related applications and the present application are assigned to the same assignee.

SUMMARY OF THE INVENTION

It is an object of the present invention to provide a plastic zipper profile located along the top edge of each wall of a plastic bag so that the zipper is opened and closed by passing a slider along the zipper. The cross sectional shape of the plastic zipper profile is such that it can be closed most easily by pressing the bottom together first, then rolling it closed toward the top. The slider is constructed so that it operates in this fashion on the profile, holding the top open while it presses the bottom together, then presses the top together while the slider passes by.

The present invention relates to a plastic reclosable fastener with a slider particularly suited for thermoplastic bags and the like comprising a pair of flexible plastic strips having separable plastic means extending along the length thereof comprising reclosable interlocking male and female profile elements on the respective strips, the strips including profiled tracks extending along the length thereof parallel to the male and female elements. The male and female elements have complimentary cross-sectional shape such that they are closed by pressing the bottom of the elements together first and then rolling the elements to a closed position toward the top thereof. A straddling slider is positioned on the tracks for closing or opening the reclosable fastener elements comprising an inverted U-shaped plastic member having a back for moving along the top edges of the tracks with side walls depending therefrom for cooperating with the tracks and extending from an opening end of the slider to a closing end. The side walls have a greater spacing at the opening end than the closing end. A separator finger depends from the back between the side walls and is inserted between the tracks. The separator finger is shaped throughout the length thereof for first holding the top of the male and female elements open while the slider first presses the bottom of the elements together and then permitting the slider to press the top of the elements together while the slider moves in a closing direction. The slider is provided with shoulders projecting inwardly from the depending side walls and shaped throughout the length thereof for cooperation with the depending separator finger in creating the rolling action in opening and closing the reclosable interlocking male and female profile elements.

Further in accordance with the present invention there is provided a closure slider for pressing together into closing relationship first and second flexible plastic continuous fastener strips comprising reclosable interlocking male and female profile elements extending longitudinally on the respective strips, the strips including profiled tracks extending along the length thereof parallel to the male and female elements. The male and female elements have complimentary cross-sectional shape such that they are closed by pressing the bottom of the elements together and then rolling the elements to a closed position toward the top thereof. The closure slider comprises a straddling slider positioned on the tracks for closing or opening the reclosable fastener elements comprising an inverted U-shaped plastic member having a back for moving along the top edges of the tracks with the side walls depending therefrom for cooperating with the tracks and extending from an opening end of the slider to a closing end. The side walls have a greater spacing at the opening end and the closing end. A separator finger depends from the back between the side walls and is inserted between the tracks. The separator finger is shaped throughout the length thereof for first holding the top of the male and female elements open while the slider first presses the bottom of the elements together and then permitting the slider to press the top of the elements together while the slider moves in a closing direction. The slider has shoulders projecting inwardly from the depending side walls and shaped throughout the length thereof for cooperating with the depending separator finger in creating the rolling action in opening and closing the reclosable interlocking male and female profile elements.

In accordance with a further aspect of the invention there is provided a method of closing a reclosable fastener with a slider wherein the fastener comprises a pair of flexible plastic strips having separable fastener means extending along the length thereof comprising reclosable interlocking rib and groove profile elements on the respective strips. The strips include profile tracks extending along the length thereof parallel to the rib and groove elements, the rib and groove elements having complementary cross-sectional shapes. A straddling slider is positioned on the tracks for closing or opening the reclosable fastener elements comprising an inverted U-shaped plastic member having a back for moving along the top edges of the tracks with side walls depending therefrom for cooperating with the track in extending from an opening end of the slider to a closing end, the side walls having a greater spacing at the opening end than the closing end. A separator finger depends from the back between the side walls and is inserted between the tracks. The method comprises the steps of mainaining the top of the rib and groove elements open with the separator finger inserted between the tracks while the slider first presses the bottom of the elements together and then permitting the slider to press the top of the elements together while the slider moves in a closing direction, and concurrently engaging the strips with shoulders projecting inwardly from the side walls to cooperate with a depending separtor finger in creating the rolling action in opening and closing the reclosable interlocking rib and groove profile elements.

Other objects and advantages of the invention will become apparent from the following detailed description of the invention taken in conjunction with the accompanying drawings.

PREFERRED EMBODIMENT OF THE INVENTION

Figure 1:
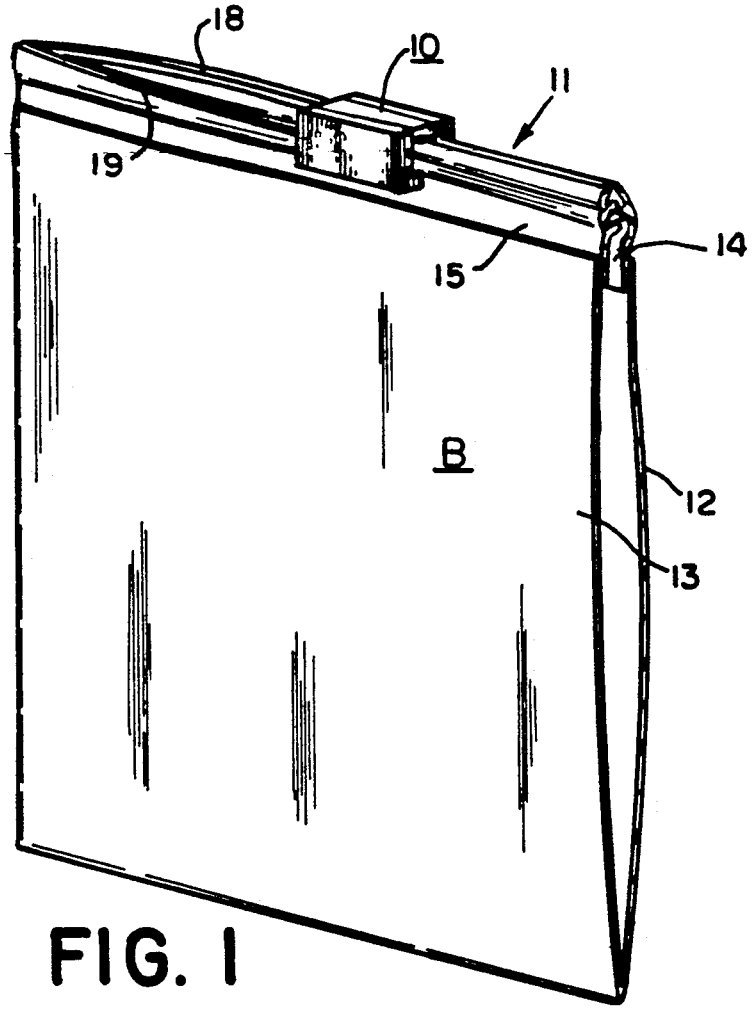
FIG. 1 is a perspective view of a thermoplastic bag or the like having a plastic slider assembled on the plastic reclosable fastener at the top edge of the bag in accordance with the present invention.
Figure 2:
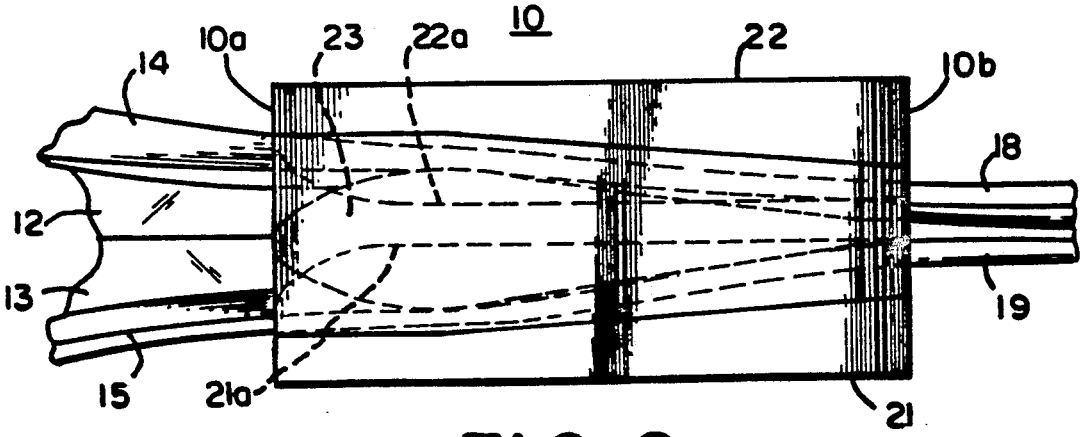
FIG. 2 is a top plan view on enlarged scale of the slider shown in FIG. 1.

Referring to FIG. 1, there is illustrated a plastic slider 10 and a profiled plastic reclosable fastener or zipper embodying the present invention. The slider 10 and zipper 11 are particularly suited for thermoplastic bags and the like and the slider 10 has been illustrated in FIGS. 1 and 2 assembled on the zipper 11 at the top edge or mouth of a thermoplastic bag B. The bag B may be made from any suitable thermoplastic film such for example as polyethylene or polypropylene or equivalent material. The bag B is formed by a pair of flexible plastic sheets 12 and 13 having a top edge having a pair of flexible plastic strips 14 and 15 having separable plastic means extending along the length thereof comprising reclosable interlocking male and female profile elements in the form of rib and groove elements 16 and 17 on the respective strips. The strips 14 and 15 may be extruded separately and attached to the respective sides of the bag mouth or the strips 14 and 15 may be extruded integral with the sides of the bag mouth. The strips 14 and 15 include profiled tracks 18 and 19 extending along the length thereof parallel to the rib and groove elements 16 and 17 and the rib and groove elements 16, 17 have complimentary cross-sectional shapes such that they are closed by pressing the bottom of the elements together first and then rolling the elements to a closed position toward the top thereof. The rib element 16 is hook shaped and projects from the inner face of strip 14. The groove element 17 includes a lower hook-shaped projection 17*a* and a relatively straight projection 17*b* which extend from the inner face of strip !5. The profiled tracks 18 and 19 are inclined inwardly toward each other from their respective strips 14 and 15. This may best be seen by reference to FIGS. 4–7.

Figure 4:
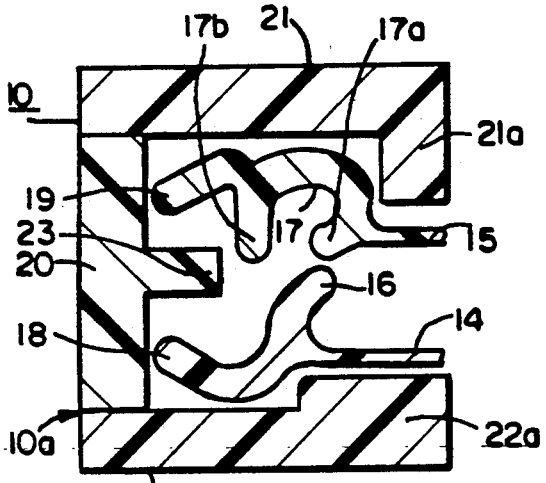
FIG. 4 is a sectional view taken along the lines 4—4 in FIG. 3 including the plastic zipper profile elements.
Figure 5:
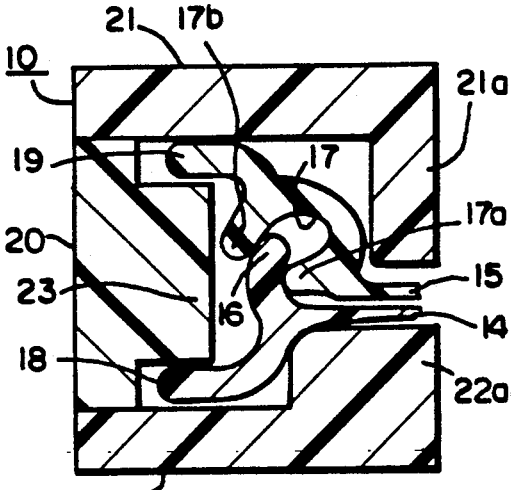
FIG. 5 is a sectional view taken along the lines 5—5 in FIG. 3 including the plastic zipper profile elements.
Figure 6:
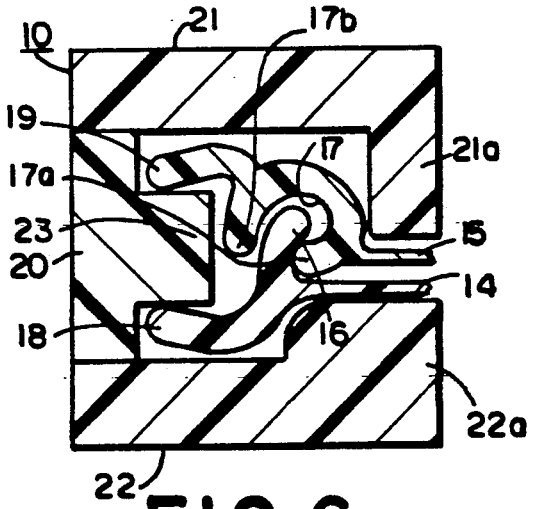
FIG. 6 is a sectional view taken along the lines 6—6 in FIG. 3 including the plastic zipper profile elements.
Figure 7:
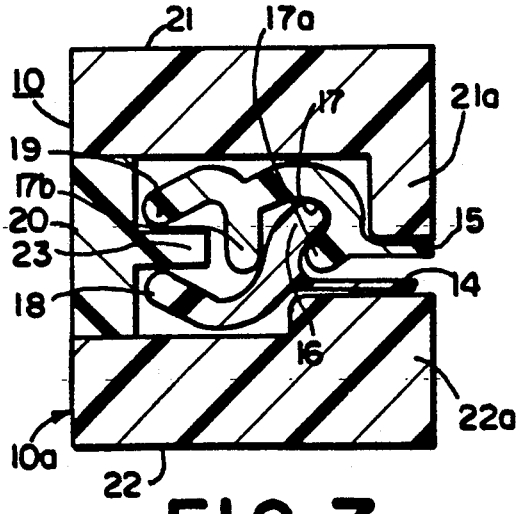
FIG. 7 a sectional view taken along the lines 7—7 in FIG. 3 including the plastic zipper profile elements.

As may be seen in FIG. 4, in the open position of the zipper the flexible plastic strips 14 and 15 are separated from each other as are the reclosable interlocking rib and groove profile elements 16 and 17 on the respective strips. The strips 14 and 15 each include one of the profile tracks 18 and 19 extending along the length thereof parallel to the rib and groove elements 16 and 17. The rib and groove elements 16 and 17 have a complementary cross-sectional shape such that they are closed by first pressing the bottom of the elements together as indicated in FIG. 5 and then rolling the elements to a closed position toward the top thereof as shown in FIGS. 6 and 7. The rolling action is accomplished by the slider 10 which straddles the track 18 and 19 and is adapted to close or open the rib and groove elements 16 and 17 of the reclosable fastener as now to be described.

The straddling slider 10 comprises an inverted U-shaped plastic member having a back 20 for moving along the top edges of the tracks 18 and 19 with side walls 21 and 22 depending therefrom for cooperating with the tracks and extending from an opening end 10*a* of the slider to a closing end 10*b*. The side walls 21 and 22 have a greater spacing therebetween at the opening end 10*a* than at the closing end 10*b* as may be seen in FIGS. 4 and 7. A separator finger 23 depends from the back 20 between the side walls 21 and 22 and is inserted between the inclined tracks 18 and 19. As may be seen in FIGS. 3–7 the separator finger 23 is shaped throughout the length thereof for first holding the top of the rib and groove elements 16 and 17 open, FIG. 4, while the slider 10 first presses the bottom of the elements together, FIG. 5 then permitting the slider 10 to press the top of the elements 16 and 17 together while the slider moves in a closing direction, FIGS. 6 and 7. The slider 10 has shoulders 21*a* and 22*a* projecting inwardly from the depending side walls 21 and 22 which are shaped throughout the length thereof for cooperation with the depending separator finger 23 in creating the rolling action in opening and closing the reclosable interlocking rib and groove profile elements 16 and 17. As may be seen in FIG. 3 the longitudinal axis of the finger 23 is displaced with respect to the axis of the spacing between the shoulders 21*a* and 22*a*. The shoulders 21*a* and 22*a* are parallel to each other throughout a substantial portion of their length and extending to the closing end 10*b* of the slider. The shoulders 21*a* and 22*a* have different thicknesses and thus different elevations with respect to groove and rib elements 17 and 16. The changing shapes of the depending separator finger 23 and the projecting shoulders 21*a* and 22*a* are best seen in FIGS. 2–8.

Figure 8:
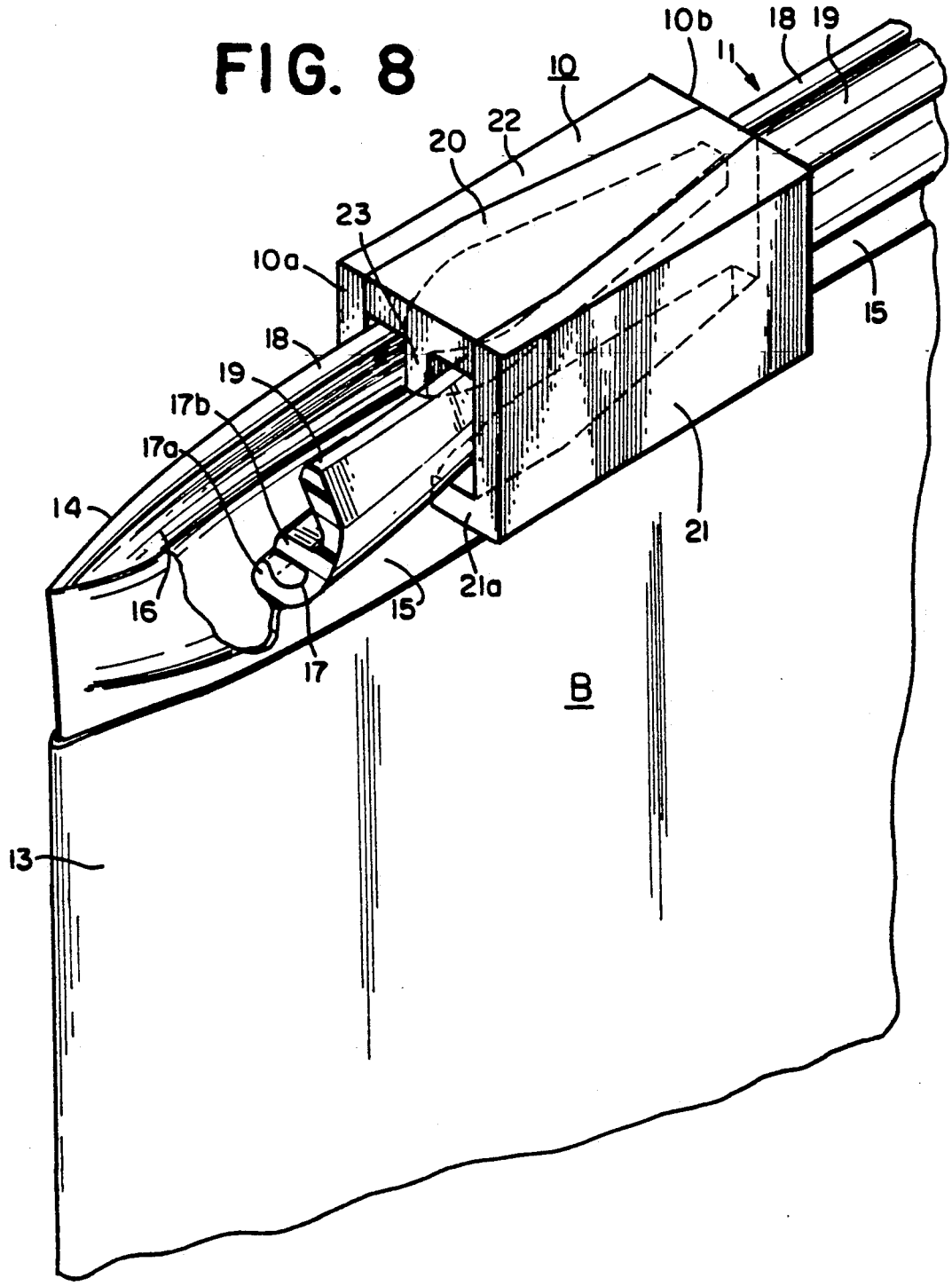
FIG. 8 is an enlarged prospective view of the reclosable fastener with slider shown from the opening end of the slider with part of the female profile element broken away for clarity.
Figure 3:
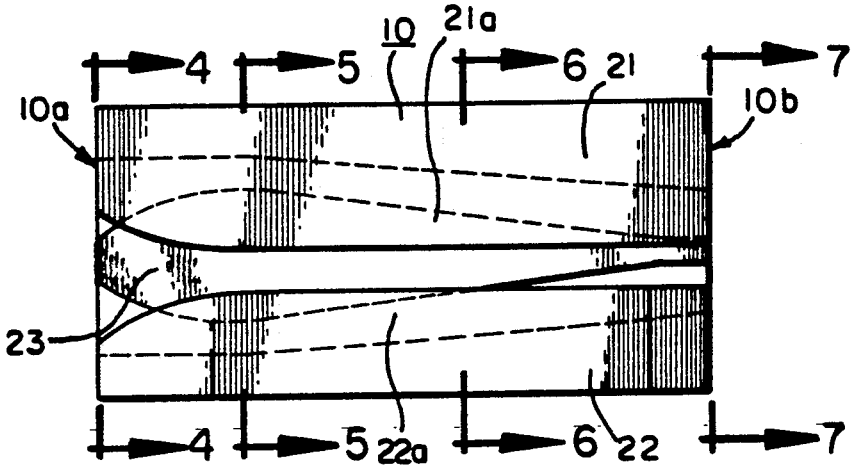
FIG. 3 is a bottom plan view of the slider shown in FIG. 2.

As may be seen in FIGS. 3 and 5, the finger 23 has a wider cross-section near the opening end 10*a* of the slider which engages the inclined tracks 18 and 19 causing them to move apart and straighten while the shoulders 22*a* and 21*a* press the strips 14 and 15 close together. This causes the rib 16 to move over the hook-shaped projection 17*a* and beneath the straight projection 17*b*. It will be seen that the shoulder 22*a* has a non-uniform width and projects inwardly in FIG. 5 a greater distance than in FIG. 4. This causes the shoulder 22*a* to engage the strip 14 opposite the base of rib 16 where it is connected to the strip 14. The shoulder 21*a* also has a non-uniform width and projects inwardly in FIG. 5 a greater distance than in FIG. 4 but is beneath the hook-shaped projection 17*a* of the groove element 17. This permits the groove element 17 to be rolled outwardly under the action of the finger 23 so that the rib 16 can enter the groove 17 the spacing between the side walls 21 and 22 is less than in FIG. 5 and the finger 23 has a narrower cross-section which permits the tracks 18 and 19 to move toward each other thus causing the rib 16 to be rolled into the groove 17 between the projections 17*a* and 17*b*. The rib 16 has been fully inserted in the groove 17 when the slider 10 has been moved to the position at the closing end 10*b* of the slider shown in FIG. 7. In FIG. 7 it will be seen that the spacing between the side walls 21 and 2 is less than in FIG. 6 and the cross section of the finger 23 is also narrower than in FIG. 6 thus permitting the reclosable fastener to be fully closed. The slider 10 may be made in multiple parts and ultrasonically welded together as disclosed in the aforesaid related application Ser. No. 490,109 or the parts may be constructed to be snapped together as disclosed in the aforesaid related application Ser. No. 490,107. The slider 10 may also be of one piece construction such as the foldable plastic sliders disclosed in the aforesaid related applications Ser. No. 490,108 and Ser. No. 490,106.

Since the slider-operated zipper disclosed and claimed herein is closed only by the slider, and never by direct hand pressure, it is not necessary that the zipper be easy to close manually. Accordingly, the novel zipper has been designed for ease of slider movement and for holding force without regard to how easily the rib and groove elements of the zipper snap directly together. This desirable result is derived from the rolling action utilized in opening and closing the zipper. The cross-sectional shape of the zipper is such that it can be closed most easily by pressing the bottom together first, then rolling it closed toward the top. The novel slider is shaped so that it operates in this fashion on the zipper profile, holding the top open while it presses the bottom together, then presses the top together while the slider passes by.

While a preferred embodiment of the invention has been described and illustrated, it is to be understood that further modifications thereof may be made within the scope of the appended claims without departing from the spirit of the invention.

What is claimed is:

1. A plastic reclosable fastener with slider particularly suited for thermoplastic bags and the like comprising a pair of flexible plastic strips having separable fastener means extending along the length thereof comprising reclosable interlocking male and female profile elements on the respective strips, said strips including profiled tracks extending along the length thereof parallel to the male and female elements, said male and female elements having complimentary cross sectional shapes such that they are closed by pressing the bottom of the elements together first and then rolling the elements to a closed position toward the top thereof, a straddling slider on said tracks for closing or opening the reclosable fastener elements comprising an inverted U-shaped plastic member having a back for moving along the top edges of said tracks with side walls depending therefrom for cooperating with said tracks and extending from an opening end of the slider to a closing end, said side walls having a greater spacing at the opening end than the closing end, a separator finger depending from said back between said side walls and inserted between said tracks, said separator finger being shaped throughout the length thereof for first holding the top of the male and female elements open while the slider first presses the bottom of the elements together and then permitting the slider to press the top of the elements together while the slider moves in a closing direction, said slider having shoulders projecting inwardly from said depending side walls and shaped throughout the length thereof for cooperation with said depending separator finger in creating the rolling action in opening and closing said reclosable interlocking male and female profile elements.

2. A plastic reclosable fastener with slider according to claim 1 wherein said top edges of said tracks are closer together than the remainder of said tracks for engaging said separator finger.

3. A plastic reclosable fastener with slider according to claim 2 wherein said tracks are inclined inwardly toward each other at the top edges thereof.

4. A plastic reclosable fastener with slider according to claim 1 wherein said separator finger has a longitudinal axis extending from the opening end of the slider to the closing end of the slider, said shoulders on said side walls are parallel to each other in spaced relation throughout a substantial portion of their length and extending to the closing end of said slider, and the axis of the spacing between said shoulders is displaced with respect to the longitudinal axis of said separator finger.

5. A plastic reclosable fastener with slider according to claim 4 wherein each of said shoulders has a non-uniform width throughout the length thereof.

6. A plastic reclosable fastener with slider particularly suited for opening and closing the mouth of thermoplastic bags comprising separable fastener means extending along the mouth of the bag comprising reclosable interlocking rib and groove profile elements on the respective sides of the bag mouth, profiled tracks extending along the respective sides of the bag mouth and parallel to the rib and groove elements, said rib and groove elements having complimentary cross-sectional shapes such that they are closed by pressing the bottom of the elements together first and then rolling the elements to a closed position toward the top thereof, a straddling slider on said tracks for closing or opening the reclosable fastener elements comprising an inverted U-shaped plastic member having a back for moving along the top edges of said tracks with side walls depending therefrom for cooperating with said tracks and extending from an opening end of the slider to a closing end, said side walls having a greater spacing at the opening end than the closing end, a separator finger depending from said back between said side walls and inserted between said tracks, said separator finger being shaped throughout the length thereof for first holding the top of the rib and groove elements open while the slider first presses the bottom of the elements together and then permitting the slider to press the top of the elements together while the slider moves in a closing direction, said slider having shoulders projecting inwardly from said depending side walls and shaped throughout the length thereof for cooperation with said depending separator finger in creating the rolling action in opening and closing said reclosable interlocking rib and groove profile elements.

7. A plastic reclosable fastener of the rolling action type for use with a slider having a separator finger particularly suited for opening and closing the mouth of the thermoplastic bags comprising separable fastener means extending along the mouth of the bag comprising reclosable interlocking rib and groove profile elements on the respective sides of the bag mouth, and profiled tracks extending along the respective sides of the bag mouth and parallel to the rib and groove elements, said profiled tracks extending above both of said rib and groove elements for engagement of said profiled tracks by the separator finger on the slider during the opening of said rib and grove elements, said rib and groove elements having complimentary cross-sectional shapes such that they are closed by first pressing the bottom of the elements together and then rolling the elements to a closed position toward the top thereof.

8. A plastic reclosable fastener according to claim 7 wherein said groove element comprises a straight projection and a hook-shaped projection, said rib element moving over said hook-shaped projection and beneath said straight projection when rolling said rib and groove elements to the closed position.

9. A slider for pressing together into closing relationship first and second flexible plastic continuous fastener strips comprising reclosable interlocking rib and groove profile elements extending longitudinally on the respective strips, the strips including profiled tracks extending along the length thereof parallel to the rib and groove elements, the rib and groove elements having complimentary cross-section shapes such that they are closed by pressing the bottom of the elements together and then rolling the elements to a closed position toward the top threof, said slider being constructed for straddling the tracks for closing or opening the reclosable fastener elements comprising an inverted U-shaped plastic member having a back for moving along the top edges of the tracks with side walls depending therefrom for cooperating with the tracks and extending from an opening end of the slider to a closing end, said side walls having a greater spacing at the opening end than the closing end, a separator finger depending from said back between said side walls for insertion between the tracks, said separator finger being shaped throughout the length thereof for first holding the top of the rib and groove elements open while the slider first presses the bottom of the elements together and then permitting the slider to press the top of the elements together while the slider moves in a closing direction, said slider having shoulders projecting inwardly from said depending side walls and shaped throughout the length thereof for cooperation with said depending separator finger in creating the rolling action in opening and closing the reclosable interlocking rib and groove profile elements.

10. A slider according to claim 9 wherein said separator finger has a longitudinal axis extending from the opening end of the slider to the closing end of the slider, said shoulders on said depending side walls are parallel to each other in spaced relation throughout a substantial portion of their length and extending to the closing end of the slider and the axis of the spacing between said shoulders is displaced with respect to the longitudinal axis of said separator finger.

11. A method of closing a reclosable fastener with a slider wherein the fastener comprises a pair of flexible plastic strips having separable fastener means extending along the length thereof comprising reclosable interlocking rib and groove profile elements on the respective strips, the strips including profiled tracks extending along the length thereof parallel to the rib and groove elements, the rib and groove elements having complimentary cross-sectional shapes, a straddling slider on the tracks for closing or opening the reclosable fastener elements comprising an inverted U-shaped plastic member having a back for moving along the top edges of the tracks with side walls depending therefrom for cooperating with the tracks and extending from an opening end of the slider to a closing end, the side walls having a greater spacing at the opening end than the closing end, a separator finger depending from the back between the side walls and inserted between the tracks, the method comprising the steps of maintaining the top of the rib and groove elements open with the separator finger inserted between the tracks while the slider first presses the bottom of the elements together and then pressing the top of the elements together while the slider moves in a closing direction, and concurrently engaging the strips with shoulders projecting inwardly from the side walls to cooperate with the depending separator finger in creating the rolling action in opening and closing the reclosable interlocking rib and groove profile elements.

* * * * *